US005436648A

United States Patent [19]

Stortz et al.

[11] Patent Number: 5,436,648

[45] Date of Patent: Jul. 25, 1995

[54] SWITCHED DIGITAL DRIVE SYSTEM FOR AN INK JET PRINTHEAD

[75] Inventors: James L. Stortz, Spring; David B. Wallace, Dallas, both of Tex.

[73] Assignee: Compaq Computer Corporation, Houston, Tex.

[21] Appl. No.: 60,295

[22] Filed: May 10, 1993

Related U.S. Application Data

[63] Continuation-in-part of Ser. No. 746,521, Aug. 16, 1991, Pat. No. 5,227,813.

[51] Int. Cl.[6] ..... B41J 2/045

[52] U.S. Cl. ..... 347/10; 347/11; 347/69

[58] Field of Search ..... 346/1.1, 140 R; 310/316, 317; 347/9, 10, 11, 12, 68, 69, 71; 307/570, 571

[56] References Cited

U.S. PATENT DOCUMENTS

| | | | |
|---|---|---|---|
| 3,857,049 | 12/1974 | Zoltan | 310/8.1 |
| 4,383,264 | 5/1983 | Lewis | 346/140 R |
| 4,513,299 | 4/1985 | Lee et al. | 346/140 R |
| 4,523,200 | 6/1985 | Howkins | 346/1.1 |
| 4,523,201 | 6/1985 | Liker | 346/1.1 |
| 4,536,097 | 8/1985 | Nilsson | 400/126 |
| 4,577,201 | 3/1986 | Murakami et al. | 346/140 R |
| 4,584,590 | 4/1986 | Fischbeck et al. | 346/140 R |
| 4,675,693 | 6/1987 | Yano et al. | 346/1.1 |
| 4,743,924 | 5/1988 | Scardovi | 346/140 R |
| 4,752,790 | 6/1988 | Scardovi | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,931,810 | 6/1990 | Iwata et al. | 346/1.1 |
| 4,963,882 | 10/1990 | Hickman | 346/1.1 |
| 4,972,211 | 11/1990 | Aoki | 346/140 R |
| 5,016,028 | 5/1991 | Temple | 346/140 R |
| 5,028,936 | 7/1991 | Bartky et al. | 346/140 R |
| 5,138,333 | 8/1992 | Bartky et al. | 346/1.1 |
| 5,204,695 | 4/1993 | Tokunaga et al. | 346/140 R |
| 5,227,813 | 7/1993 | Pies et al. | 346/140 R |

FOREIGN PATENT DOCUMENTS

| | | | |
|---|---|---|---|
| 0364136 | 4/1990 | European Pat. Off. | B41J 2/045 |
| 0402172 | 12/1990 | European Pat. Off. | B41J 2/045 |
| 0485241 | 5/1992 | European Pat. Off. | B41J 2/045 |
| 3820082 | 12/1988 | Germany . | |
| 3924960 | 1/1991 | Germany . | |
| 3924961 | 1/1991 | Germany . | |
| 3-293144 | 12/1991 | Japan | 347/10 |

OTHER PUBLICATIONS

Wallace, David B., entitled "A Method of Characteristic Model of a Drop-on-Demand Ink-Jet Device Using an Integral Method Drop Formation Model", 89-WA/-FE-4 (1989).

Tsao, C. S., entitled "Drop-on-Demand Ink Jet Nozzle Array with Two Nozzles/Piezoelectric Crystal", *IBM Technical Disclosure Bulletin*, vol. 23 No. 10 (Mar. 1981).

*Primary Examiner*—Benjamin R. Fuller
*Assistant Examiner*—Alrick Bobb
*Attorney, Agent, or Firm*—Konneker & Eush

[57] ABSTRACT

A switched digital drive system is used to actuate an ink jet printhead having a spaced, parallel series of internal ink receiving channels opening outwardly at front ends thereof through ink discharge orifices formed in the printhead body. The channels are laterally bounded by a spaced series of piezoelectrically deflectable internal sidewall sections of the printhead body interdigitated with the channels. The drive system includes a series of electrical actuation leads each connected to a different one of the sidewall sections, and dual transistor switch structures connected in the leads with each switch, in turn, connected to positive and negative DC voltage sources. To actuate a selected channel, the switches associated with its opposite bounding sidewall sections are operated in a manner sequentially (1) deflecting the sidewall sections outwardly away from initially undeflected positions thereof by imposing constant, opposite polarity voltages thereon, (2) reversing the polarities of the constant voltages to deflect the sidewall sections into the channel, and then (3) imposing a series of voltage pulses of sequentially opposite polarities on each of the inwardly deflected sidewall sections to controllably return them to their initial undeflected positions.

18 Claims, 2 Drawing Sheets

SWITCHED DIGITAL DRIVE SYSTEM FOR AN INK JET PRINTHEAD

CROSS REFERENCE TO RELATED APPLICATIONS

This application is a continuation in part of U.S. patent application Ser. No. 07/746,521 filed Aug. 16, 1991, entitled "Sidewall Actuator For A High Density Ink Jet Printhead", U.S. Pat. No. 5,227,813, assigned to the Assignee of the present application, and hereby incorporated by reference as if reproduced in its entirety.

This application is also related to the following patent applications:

| Serial No. | First Named Inventor | Title |
|---|---|---|
| 08/060,460 | Stortz | Spot Size Modulatable Ink Jet Printhead |
| 08/060,296 | Stortz | Differential Drive System For An Ink Jet Printhead |
| 08/060,294 | Wallace | Droplet Volume Modulation Techniques For Ink Jet Printheads |
| 08/060,297 | Stortz | Dual Element Switched Digital Drive System For An Ink Jet Printhead |
| 08/060,298 | Williamson | Three Element Switched Digital Drive System For An Ink Jet Printhead |

All of the above listed applications were filed on even date herewith, assigned to the Assignee of the present invention, and hereby incorporated by reference as if reproduced in their entirety.

BACKGROUND OF THE INVENTION

1. Field of the Invention

The present invention generally relates to ink jet printhead apparatus and more particularly relates to a digital drive system for piezoelectrically driving an ink jet printhead.

2. Description of Related Art

A piezoelectrically actuated ink jet printhead is a relatively small device used to selectively eject tiny ink droplets onto a paper sheet operatively fed through a printer, in which the printhead is incorporated, to thereby form from the ejected ink droplets selected text and/or graphics on the sheet. In one representative configuration thereof, an ink jet printhead has a horizontally spaced parallel array of internal ink-receiving channels. These internal channels are covered at their front ends by a plate member through which a spaced series of small ink discharge orifices are formed. Each channel opens outwardly through a different one of the spaced orifices.

A spaced series of internal piezoelectric wall portions of the printhead body separate and laterally bound the channels along their lengths. To eject an ink droplet through a selected one of the discharge orifices, the two printhead sidewall portions that laterally bound the channel associated with the selected orifice are piezoelectrically deflected into the channel and then returned to their normal undeflected positions. The driven inward deflection of the opposite channel wall portions increases the pressure of the ink within the channel sufficiently to force a small quantity of ink, in droplet form, outwardly through the discharge orifice.

According to a recently proposed drive method for this type of ink jet printhead, top sides of the internal channel dividing wall portions are commonly connected to ground, and the bottom sides of the wall portions are individually connected to a series of electrical actuating leads. Each of these leads, in turn, is connected to a drive system operable to selectively impart to the lead an electrical waveform that sequentially changes (1) from ground to a first driving polarity, (2) from the first polarity to the opposite polarity, and (3) from the opposite polarity back to ground.

When this electrical waveform is imparted to a piezoelectric wall portion bounding one side of a selected, and a second electrical waveform of opposite polarity sequence is simultaneously imparted (via another one of the actuating leads) to the opposite channel wall portion, the opposite channel wall portions, by piezoelectrical action, are sequentially deflected (1) outwardly away from the channel that they laterally bound, (2) into the channel to discharge an ink droplet therefrom, and (3) back to their starting or "neutral" positions.

Both analog and digital type drive systems have been suggested for providing the above drive method in an ink jet printhead. As analog type drive systems which utilize analog circuitry, for example, operational amplifiers (or "op-amps"), to deliver the desired electrical waveform to the ink jet printhead are linear in nature, however, such drive systems tend to produce unacceptably high levels of power dissipation and have, therefore, proven inefficient in use. Furthermore, such analog type drive systems require excessive space on the printhead, thereby adversely affecting driver density for the printhead.

Proposed digital type drive systems, on the other hand, while avoiding the aforementioned deficiencies relating to power dissipation, also have several built-in limitations and disadvantages. More specifically, such digital type drive systems utilize switching type circuits, also referred to as "digital drivers". Since the proposed drive method requires a bipolar voltage waveform with an active return to ground, digital type drive systems have heretofore required three separate drivers—one for each of the three channel wall drive portions described above. This requirement substantially increases the complexity of the drive system, thereby undesirably increasing its overall cost. Additionally, it undesirably increases the overall space requirement for the drive system.

It can be readily seen from the foregoing that it would be desirable to provide an improved ink jet printhead drive system that eliminates, or at least substantially reduces, the above-mentioned limitations and disadvantages associated with the drive systems described above. It is accordingly an object of the present invention to provide such an improved ink jet printhead drive system.

SUMMARY OF THE INVENTION

In carrying out principles of the present invention, in accordance with a preferred embodiment thereof, a specially designed digital drive system is incorporated in an ink jet printhead having a spaced, parallel series of internal ink receiving channels opening outwardly, at front ends thereof, through a spaced series of small ink discharge orifices formed through a front end section of the printhead body. Each of the channels is laterally bounded along its length by an actuation portion of the printhead body that may be piezoelectrically deflected relative to the channel to force a quantity of ink therefrom outwardly through its associated ink discharge orifice.

The digital drive system is operative to actuate a selected one of the ink receiving channels and includes first means for piezoelectrically deflecting the selected channel actuation portion, from an initially deflected position thereof, inwardly into the selected channel, and second means for piezoelectrically returning the inwardly deflected actuation portion to its initially undeflected position by imparting to the inwardly deflected actuation portion a series of driving voltage pulses of sequentially reversed polarities.

In an illustrated preferred embodiment of the drive system it is representatively incorporated in an ink jet printhead in which, for each channel, the actuation portion is defined by an opposed pair of piezoelectrically deflectable internal sidewall sections of the printhead body that define opposite side portions of the channel along its length. The drive system comprises a series of electrical actuation leads each operatively connected to a different one of the internal sidewall sections, and a series of switch means each connected to a different one of the electrical actuation leads and to positive and negative DC voltage sources.

Each of the switch means is operative to create a positive voltage in its associated electrical actuation lead in response to receipt of a first control signal, and further operative to create a negative voltage in its associated electrical actuation lead in response to receipt of a second control signal. Means are provided for selectively transmitting said first and second control signals to predetermined ones of the switch means.

Each of the switch means preferably include a first transistor having a base portion operative to receive the first control signal, a collector portion connected to the positive voltage source, and an emitter portion connected to one of the electrical actuation leads; and a second transistor having a base portion operative to receive the second control signal, a collector portion connected to the electrical actuation lead, and an emitter portion connected to the negative voltage source.

In its preferred embodiment, the digital drive system of the present invention is operative to sequentially (1) laterally outwardly deflect, from their initial undeflected positions, the opposing pair of internal body sidewall sections of the selected channel by simultaneously imposing opposite polarity DC voltages thereon, (2) laterally inwardly deflect the outwardly deflected sidewall sections, into the selected channel, by simultaneously reversing the polarities of the DC voltages imposed thereon, and then (3) controllably return the inwardly deflected sidewall sections to their initial undeflected positions by simultaneously imposing on each of the inwardly deflected sidewall sections a series of sequentially reversed polarity DC voltage pulses.

The switched digital drive system of the invention provides several advantages over prior digital type printhead drive systems that require three separate drivers—one for each of the three sidewall movement segments described above. For example, the digital drive system of the present invention requires only two drivers. Additionally, the digital drive system is considerably less complex and is thus less expensive. Moreover, the digital drive system requires appreciably less space.

DETAILED DESCRIPTION

Figure 1:
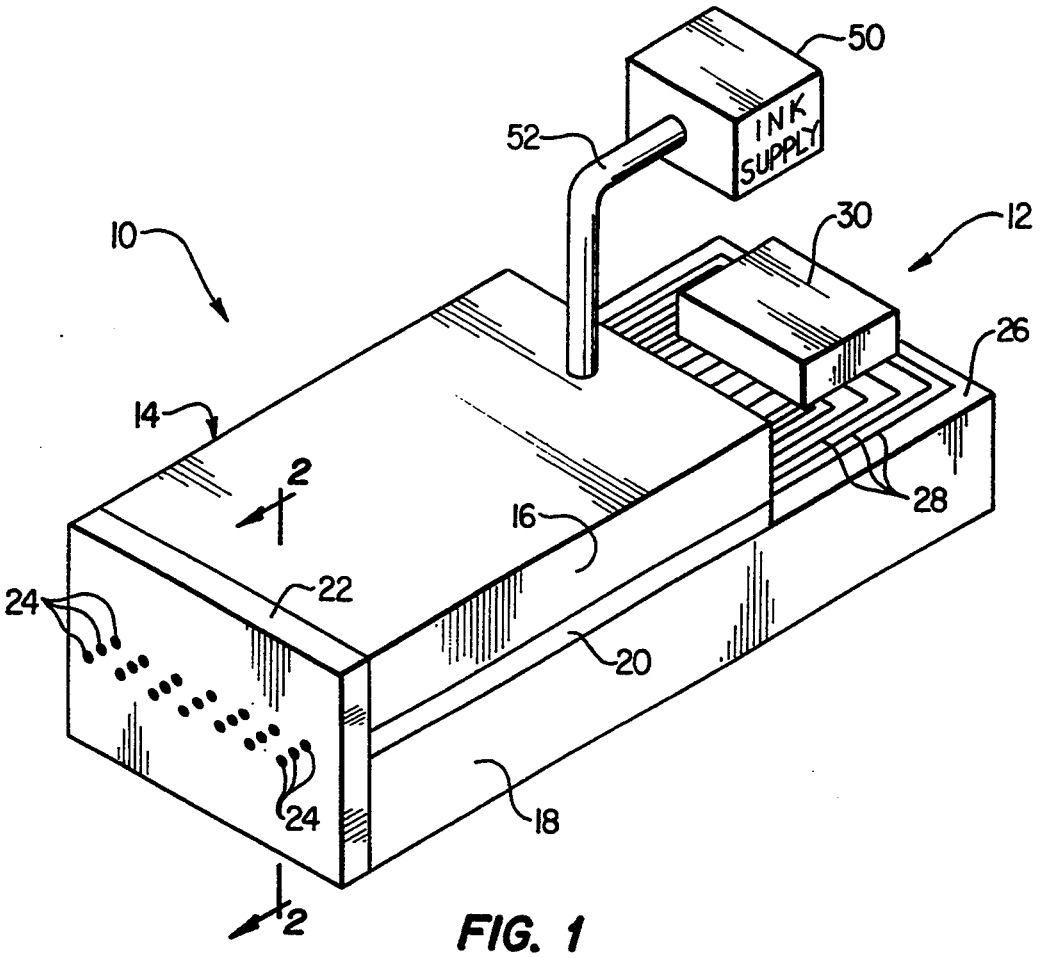
FIG. 1 is a simplified, somewhat schematic perspective view of an ink jet printhead incorporating therein a specially designed switched digital drive system embodying principles of the present invention.
Figure 2:
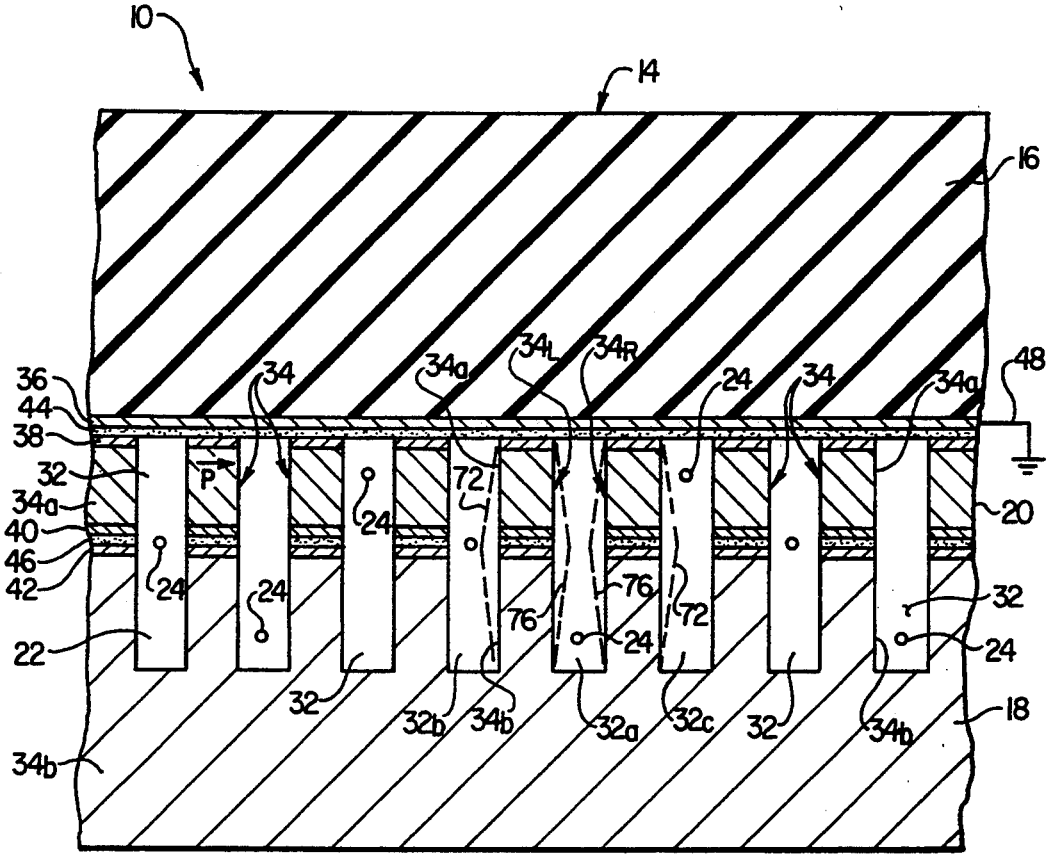
FIG. 2 is an enlarged scale partial cross sectional view through the printhead taken along line 2—2 of FIG. 1.

Referring initially to FIGS. 1 and 2, the present invention provides an ink jet printhead 10 incorporating therein a specially designed switched digital drive system 12 embodying principles of the invention. Printhead 10 has a body 14 having upper and lower rectangular portions 16 and 18, with an intermediate rectangular body portion 20 secured between the upper and lower portions 16 and 18 in the indicated aligned relationship therewith. A front end section of the body 14 is defined by an orifice plate member 22 having a spaced series of small ink discharge orifices 24 extending rearwardly therethrough. As shown, the orifices 24 are arranged in horizontally sloped rows of three orifices each.

In a left-to-right direction as viewed in FIG. 1, the printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller portion 30 of the drive system 12 mounted on the surface 26 near the rear end of the body portion 18.

Referring now to FIG. 2, a plurality of vertical grooves of predetermined width and depth are formed in the printhead body portions 18 and 20 to define within the printhead body 14 a spaced, parallel series of internal ink receiving channels 32 that longitudinally extend rearwardly from the orifice plate 22 and open at their front ends outwardly through the orifices 24. The channels 32 are laterally bounded along their lengths by opposed pairs of a series of internal actuation sidewall sections 34 of the printhead body.

Sidewall sections 34 have upper parts **34*a* defined by horizontally separated vertical sections of the body portion 20, and lower parts 34*b* defined by horizontally separated sections of the body portion 18. The underside of the body portion 16, the top and bottom sides of the actuation sidewall section parts 34*a*, and the top sides of the actuation sidewall section parts 34*b* are respectively coated with electrically conductive metal layers 36, 38, 40 and 42**.

Body portions 16 and 20 are secured to one another by a layer of electrically conductive adhesive material 44 positioned between the metal layers 36 and 38, and the upper and lower actuator parts 34a and 34b are intersecured by layers of electrically conductive material 46 positioned between the metal layers 40 and 42. The metal layer 36 on the underside of the upper printhead body portion 16 is connected to ground 48. Accordingly, the top sides of the upper actuator parts 34a are electrically coupled to one another and to ground 48 via the metal layers 38, the conductive adhesive layer 44 and the metal layer 36.

Each of the channels 32 is filled with ink received from a suitable ink supply reservoir 50 (see FIG. 1) connected to the channels via an ink delivery conduit 52 connected to an ink supply manifold (not shown) disposed within the printhead body 14 and coupled to rear end portions of the internal channels 32. In a manner subsequently described, each horizontally opposed pair of the sidewall actuators 34 is piezoelectrically deflectable into and out of their associated channel 32, under the control of the digital drive system 12, to force ink (in droplet form) outwardly through the orifice 24 associated with the actuated channel.

Figure 3A:
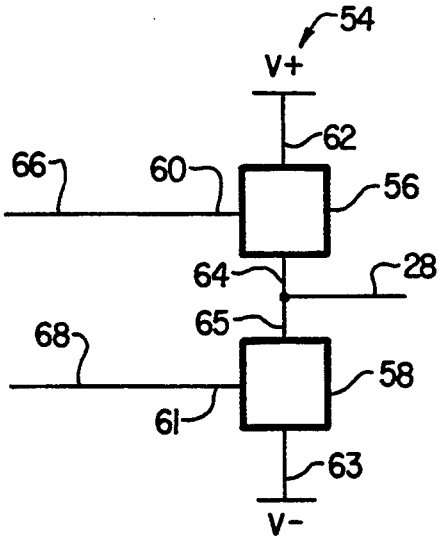
FIG. 3A is a schematic wiring diagram of a dual switching element digital drive system incorporated in the printhead drive system of the present invention.

Referring now to FIGS. 1 and 3A, as previously mentioned, the digital drive system 12 includes the controller 30 which is operatively connected to rear ends of the electrical actuation leads 28. The front ends of the leads 28 are individually connected to the metal layers 40 (see FIG. 2) on the undersides of the top sidewall actuator parts 34a. Within the controller 12 are a series of switching structures 54 each of which is connected to one of the leads 28 as schematically depicted in FIG. 3A.

Each switching structure 54 includes first and second switching elements 56, 58. It is contemplated that various switching circuits, for example, a bipolar transistor or a field effect transistor, are suitable for use as the switching elements 56, 58. The first switching element 56 has a control input line 60 connected to a first drive signal 66, a supply voltage input line 62 connected to a positive DC voltage source and an output line 64 connected to lead 28. Similarly, the second switching element 58 has a control input line 61 connected to a second drive signal 68, a supply voltage input line 63 connected to a negative DC voltage source and an output line 65 connected to lead 28. In operation, the first drive signal 66 is asserted during a first time interval to produce a positive pulse as the output at lead 28 which would drive a piezoelectric wall portion electrically associated therewith in a first direction. Then, during a second time interval, the first drive signal 66 is deasserted and the second drive signal 68 is asserted, thereby causing the output at lead 28 to transition from positive to negative, thereby driving the piezoelectrical wall portion electrically associated therewith in the opposite direction. Finally, during a third time interval, the second drive signal 68 is deasserted and the output is returned to ground to allow the piezoelectrical wall portion to return to its rest position. While the output will return to ground over time, it is contemplated that the drive signals 66, 68 may be used in various drive methods during the third time interval to drive the output to ground. One such technique will be described below with reference to FIG. 4.

With respect to each of the dual switching elements 56, 58, the controller 30 is operative to selectively transmit a first control signal 66 to the control input 60 of the switching element 56, or a second control signal 68 to the control input 61 of the second switching element 58. Receipt of the first control signal 66 by the switching structure 54 creates a positive DC voltage in its associated electrical actuation lead 28, while receipt of the second control signal 68 by the switching structure 54 creates a negative DC voltage in the lead 28. Via the lead 28, this positive or negative DC voltage is transmitted to the upper actuation sidewall portion metal layer 40 to which the lead is operatively connected.

Using the switched digital drive system 12 of the present invention a selected one or more of the ink receiving channels 32 may be actuated to drive a quantity of ink therein, in droplet form, outwardly through the associated ink discharge orifice(s) 24. To illustrate the operation of the digital drive system 12, the actuation of a representative channel 32a will be described shortly in conjunction with FIGS. 2 and 4.

Figure 3B:
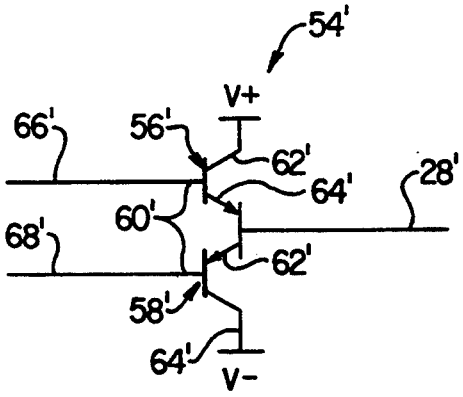
FIG. 3B is a schematic wiring diagram of a specific embodiment of the dual switching element digital drive system of FIG. 3A.

Referring now to FIG. 3B, a specific embodiment of the switching structure 54 will now be described in greater detail. In this embodiment, each switching element 54' includes a pair of transistors 56' and 58', each having a base portion 60', a collector portion 62', and an emitter portion 64'. As illustrated, the collector portion 62' of transistor 56' is connected to a positive DC voltage source, the emitter portion 64' of transistor 58' is connected to a negative DC voltage source, and the emitter portion 64' of transistor 56' and the collector portion 62' of transistor 58' are connected to the lead 28'.

With respect to each of the dual transistor switches 54', the controller 30 is operative to selectively transmit a first control signal 66' to the base portion 60' of the transistor 56', or a second control signal 68' to the base portion 60' of the transistor 58'. Receipt of the first control signal 66' by the switching structure 54' creates a positive DC voltage in its associated electrical actuation lead 28', while receipt of the second control signal 68' by the switching structure 54' creates a negative DC voltage in the lead 28'. Via the lead 28', this positive or negative DC voltage is transmitted to the upper actuation sidewall portion metal layer 40 to which the lead is operatively connected.

Figure 4:
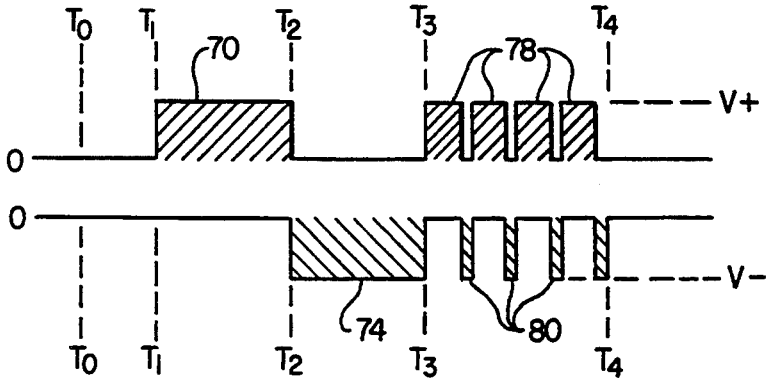
FIG. 4 is a schematic digital electric waveform diagram illustrating a representative actuation sequence of one of the dual switching elements of FIG. 3A.

Referring now to FIGS. 2 and 4, the operation of the digital drive system 12 incorporating a switching circuit 54 such as that illustrated in FIG. 3A, will now be described. Prior to the actuation of the channel 32a, its horizontally opposed left and right sidewall actuators $34_L$ and $34_R$ are (at time $T_o$ in FIG. 4) in initial, laterally undeflected positions indicated by solid lines in FIG. 2. To initiate the channel actuation cycle, the switching structure 54 associated with the left sidewall actuator $34_L$ is operated to impose thereon a constant positive DC voltage pulse 70 during the time interval $T_1$–$T_2$ shown in FIG. 4. Simultaneously, the switching structure 54 associated with the right sidewall actuator $34_R$ is operated to impose thereon an equal constant negative DC voltage pulse during the time interval $T_1$–$T_2$. These opposite polarity DC voltage pulses transmitted to the sidewall actuators $34_L$ and $34_R$ outwardly deflect them away from the channel 32a being actuated and into the outwardly adjacent channels 32b and 32c as indicated by the dotted lines 72 in FIG. 2.

Next, at time $T_2$, the positive voltage pulse 70 transmitted to sidewall actuator $34_L$ and the corresponding negative voltage pulse on the sidewall actuator $34_R$ are terminated, and the two switching structures 54 are operated to simultaneously impose a constant negative DC voltage pulse 74 on the left sidewall actuator $34_L$, while imposing an equal constant positive DC voltage pulse on actuator $34_R$, during the time interval $T_2$–$T_3$.

These opposite polarity constant DC voltage pulses inwardly deflect the sidewall actuators $34_L$ and $34_R$ past their initial undeflected positions and into the channel 32a as indicated by the dotted lines 76 in FIG. 2. Such inward deflection of the actuators reduces the volume of channel 32a, thereby elevating the pressure of ink therein to an extent sufficient to force a quantity of the ink, in droplet form, outwardly through the orifice 24 associated with the actuated channel 32a.

Finally, at time $T_3$, these second opposite polarity DC voltage pulses are terminated and the switching structure 54 associated with sidewall actuator $34_L$ is operated to piezoelectrically drive the actuator $34_L$ back to its initial undeflected position by imposing thereon an alternating series of positive and negative voltage pulses 78 and 80 during the final time interval $T_3$–$T_4$. As illustrated in FIG. 4, the total time duration of the positive voltage pulses 78 is greater than the total time duration of the negative pulses 80. Accordingly, the net lateral deflection force on the sidewall actuator $34_L$ is outwardly directed.

Also during the time interval $T_3$–$T_4$ the switching structure 54 associated with the right sidewall actuator $34_R$ is used to piezoelectrically drive such actuator back to its initial undeflected position by imposing thereon an alternating polarity DC voltage pulse pattern which is a mirror image of the $T_3$–$T_4$ pulse pattern shown in FIG. 4, with the total time duration of the negative voltage pulses being equal to the time duration of the positive voltage pulses 78 in FIG. 4.

The unique use of these alternating polarity voltage pulses to return the actuators $34_L$, $34_R$ from their inwardly deflected positions to their initial undeflected positions during the representative time interval $T_3$–$T_4$ improves the ability to control and "smooth out" their final return stroke as desired. This enhanced control of their return strokes may easily be adjusted to provide variable return stroke characteristics by adjusting the time interval $T_3$–$T_4$ and/or the relative negative and positive pulse time duration for the voltage pulse series imposed on each actuator during time interval $T_3$–$T_4$.

Compared to other analog or digital drive systems used to actuate selectively variable internal ink receiving channels in an ink jet printhead, the switched digital drive system 12 of the present invention provides several desirable advantages. For example, other digital drive systems typically require three separate drivers—i.e., (1) a ground-to-positive driver, (2) a positive-to-negative driver, and (3) a negative-to ground driver. In contrast to this three driver requirement, the digital drive system 12 subject of the present invention requires only two drivers. This reduction in the number of drivers required substantially reduces the complexity of the drive system. In turn, this materially lessens the overall cost of the drive system. Additionally, the reduced driver requirement advantageously reduces the overall space requirement for the drive system. Likewise, when compared to analog drive systems, the disclosed digital drive system has achieved a significant reduction in space requirements.

The foregoing detailed description is to be clearly understood as being given by way of illustration and example only, the spirit and scope of the present invention being limited solely by the appended claims.

What is claimed is:

1. A method of operatively driving a piezoelectrically deflectable wall portion which partially bounds an ink receiving internal channel of an ink jet printhead, said method comprising the steps of:

imparting a first continuous polarity voltage to the wall portion to piezoelectrically drive the wall portion, from an initial undeflected position thereof, to an outwardly deflected position relative to said channel;

imparting a second continuous opposite polarity voltage to the outwardly deflected wall portion to piezoelectrically drive the wall portion past said initial undeflected position to an inwardly deflected position within said channel, and then imparting a series of voltage pulses of sequentially opposite polarities to the inwardly deflected wall portion to piezoelectrically drive the wall portion back to said initial undeflected position.

2. The method of claim 1 wherein the step of imparting a series of voltage pulses of sequentially opposite polarities to the inwardly deflected wall portion to piezoelectrically drive the wall portion back to said initial undeflected position further comprises the steps of:

imparting, for a first period of time, said first continuous polarity voltage to the wall portion;

imparting, for a second period of time, said second continuous opposite polarity voltage to the wall portion, said second period of time shorter than said first period of time; and repeating the steps of imparting said first continuous polarity voltage and said second continuous opposite polarity voltage to the wall portion until the wall portion is driven back to said initial undeflected position.

3. The method of claim 2 and further comprising the step of selecting said first and said second period of time to control the driving back of the wall portion to said initial undeflected position.

4. An ink jet printhead comprising:

a body having a spaced series of piezoelectrically deflectable actuation portions and a front end section with a spaced series of ink discharge orifices extending rearwardly therethrough;

a spaced series of enclosed ink receiving channels, each of said channels longitudinally extending rearwardly through an interior of said body and opening outwardly through one of said orifices, each one of said channels being partially bounded by one of said actuation portions of said body; and drive means for actuating a selected one of said ink receiving channels, said drive means including:

means for piezoelectrically deflecting a selected actuation portion partially bounding said selected one of said ink receiving channels, from an initially undeflected position thereof, inwardly into the selected one of said ink receiving channels, and means for imparting a series of driving voltage pulses of sequentially reversed polarities to said inwardly deflected actuation portion to piezoelectrically return said inwardly deflected actuation portion to said initially undeflected position;

a series of electrical actuation leads, each of said electrical actuation leads operatively connected to a different one of said series of actuation portions;

a series of switch means, each of said switch means connected to a different one of said electrical actuation leads and to positive and negative voltage sources;

each of said switch means for creating a positive voltage in said electrical actuation leads operatively connected thereto in response to receipt of a first control signal and creating a negative voltage in said electrical actuation leads operatively connected thereto in response to receipt of a second control signal; and means for selectively transmitting said first and said second control signal to predetermined ones of said switch means.

5. The ink jet printhead of claim 4 wherein each of said switch means include:

a first switching element having a control input operative to receive said first control signal, a voltage supply input connected to said positive voltage source, and an output connected to one of said electrical actuation leads, and a second switching element having a control input operative to receive said second control signal, a voltage supply input connected to said negative voltage source, and an output connected to said one of said electrical actuation leads.

6. The ink jet printhead of claim 5 wherein said first switching element further comprises a first transistor having a base operative to receive said first control signal, a collector connected to said positive voltage source, and an emitter connected to one of said electrical actuation leads, and said second switching element further comprises a second transistor having a base operative to receive said second control signal, a collector connected to said one of said electrical actuation leads, and an emitter connected to said negative voltage source.

7. The ink jet printhead of claim 4 wherein:

each of said positive and negative voltage sources is a DC voltage source.

8. The ink jet printhead of claim 4 wherein, for each of said channels, said actuation portion partially bounding said channel comprises an opposing pair of internal sidewall sections of said body laterally bounding the channel.

9. An ink jet printhead comprising:

a body having spaced series of piezoelectrically deflectable actuation portions and a front end section with a spaced series of ink discharge orifices extending rearwardly therethrough;

a spaced series of enclosed ink receiving channels, each of said channels extending rearwardly through an interior of said body and opening outwardly through one of said orifices, each one of said series of channels being partially bounded by one of said series of actuation portions of said body; and drive means for actuating a selected one of said series of channels, said drive means including:

means for imparting a first driving voltage having a first polarity to a selected one of said actuation portions which partially bounds said selected one of said series of channels to outwardly deflect said selected one of said actuation portions, from an initial position thereof, away from said selected one of said series of channels;

means for imparting a second driving voltage having a second polarity opposite from said first polarity to said selected one of said series of actuation portions to inwardly deflect the outwardly deflected actuation portion past said initial position thereof and into said selected one of said series of channels; and means for imparting a series of driving voltage pulses of sequentially opposite polarities to outwardly deflect the inwardly deflected actuation portion to said initial position thereof.

10. The ink jet printhead of claim 9 wherein said drive means includes:

a series of electrical actuation leads, each of said electrical actuation leads operatively connected to a different one of said series of actuation portions;

a series of switch means, of each of said switch means connected to a different one of said electrical actuation leads and to positive and negative voltage sources;

each of said switch means for creating a positive voltage in said electrical actuation leads operatively connected thereto in response to receipt of a first control signal and a negative voltage in said electrical actuation leads operatively connected thereto in response to receipt of a second control signal; and means for selectively transmitting said first and said second control signal to predetermined ones of said switch means.

11. The ink jet printhead of claim 10 wherein each of said switch means include:

a first switching element having a control input operative to receive said first control signal, a voltage supply input connected to said positive voltage source, and an output connected to one of said electrical actuation leads, and a second switching element having a control input operative to receive said second control signal, a voltage supply input connected to said negative voltage source, and an output connected to said one of said electrical actuation leads.

12. The ink jet printhead of claim 11 wherein said first switching element further comprises a first transistor having a base operative to receive said first control signal, a collector connected to said positive voltage source, and an emitter connected to one of said electrical actuation leads, and said second switching element further comprises a second transistor having a base operative to receive said second control-signal, a collector connected to said one of said electrical actuation leads, and an emitter connected to said negative voltage source.

13. The ink let printhead of claim 10 wherein:

each of said positive and negative voltage sources is a DC voltage source.

14. An ink jet printhead comprising:

a body having a front end section with a spaced series of ink discharge orifices extending rearwardly therethrough, said body further having a spaced, parallel series of internal sidewall sections extending rearwardly through said body from said front section thereof and laterally bounding a spaced series of internal ink receiving channels interdigitated therewith and opening outwardly through said discharge orifices such that an opposing pair of said sidewall sections laterally bound one of said spaced series of channels, said opposing pair of said sidewall sections being piezoelectrically deflectable, from initial undeflected positions thereof, into and outwardly away from a channel which they laterally bound; and digital drive means for actuating a selected one of said channels in a manner causing a quantity of ink disposed therein to be ejected through a discharge orifice associated with said channel, said digital drive means including:

means for simultaneously imposing opposite polarity DC voltages on the opposing pair of internal body sidewall sections which bound the selected channel to laterally outwardly deflect, from initial undeflected positions, the opposing pair of internal body sidewall sections which bound the selected channel;

means for simultaneously reversing the polarities of the DC voltages imposed on the opposing pair of internal body sidewall sections which bound the selected channel to laterally inwardly deflect the outwardly deflected sidewall sections into the selected channel; and means for imparting a series of sequentially reversed polarity DC voltage pulses on each one of the opposing pair of internal body sidewall sections which bound the selected channel to controllably return the inwardly deflected sidewall sections to said initial undeflected positions.

15. The ink jet printhead of claim 14 wherein said digital drive means includes:

a series of electrical actuation leads, each of said electrical actuation leads operatively connected to a different one of said internal sidewall sections;

a series of switch means, each of said switch means connected to a different one of said electrical actuation leads and to positive and negative voltage sources;

each of said switch means for creating a positive voltage in said electrical actuation leads operatively connected thereto in response to receipt of a first control signal and creating a negative voltage in said electrical actuation leads operatively connected thereto in response to receipt of a second control signal; and means for selectively transmitting said first and said second control signal to predetermined ones of said switch means.

16. The ink jet printhead of claim 15 wherein each of said switch means include:

a first switching element having a control input operative to receive said first control signal, a voltage supply input connected to said positive voltage source, and an output connected to one of said electrical actuation leads, and a second switching element having a control input operative to receive said second control signal, a voltage supply input connected to said negative voltage source, and an output connected to said one of said electrical actuation leads.

17. The ink jet printhead of claim 16 wherein said first switching element further comprises a first transistor having a base operative to receive said first control signal, a collector connected to said positive voltage source, and an emitter connected to one of said electrical actuation leads, and said second switching element further comprises a second transistor having a base operative to receive said second control signal, a collector connected to said one of said electrical actuation leads, and an emitter connected to said negative voltage source.

18. The ink jet printhead of claim 15 wherein:

each of said sidewall sections has a first portion connected to ground, and a second portion spaced apart from said first portion in a direction transverse to a length of said channels, and said electrical actuation leads are connected to said second portion of said sidewall sections.

* * * * *